US005244097A

United States Patent [19]

Leiponen et al.

[11] Patent Number: 5,244,097

[45] Date of Patent: Sep. 14, 1993

[54] APPARATUS FOR FEEDING AIR INTO A FLOTATION CELL

[75] Inventors: Matti O. Leiponen, Espoo; Launo L. Lilja; Valto J. Makitalo, both of Pori, all of Finland

[73] Assignee: Outokumpu Oy, Helsinki, Finland

[21] Appl. No.: 916,032

[22] Filed: Jul. 17, 1992

Related U.S. Application Data

[63] Continuation-in-part of Ser. No. 639,040, Jan. 9, 1991, Pat. No. 5,143,600.

[30] Foreign Application Priority Data

Jan. 10, 1990 [FI] Finland ..... 9000123

[51] Int. Cl.[5] ..... B03D 1/16; B01F 3/04

[52] U.S. Cl. ..... 209/169; 261/93; 210/221.1; 366/102

[58] Field of Search ..... 210/219, 220, 221.1; 209/169; 261/93; 366/102

[56] References Cited

U.S. PATENT DOCUMENTS

| | | | |
|---|---|---|---|
| 1,976,956 | 10/1934 | MacLean | 209/169 |
| 2,243,309 | 5/1941 | Daman | 209/169 |
| 2,259,243 | 10/1941 | Daman | 209/169 |
| 2,806,681 | 9/1957 | Fahrenwald | 209/169 |
| 2,875,897 | 3/1959 | Booth | 209/169 |
| 3,437,203 | 4/1969 | Nakamura | 209/169 |
| 3,791,104 | 2/1974 | Clitheroe | 209/169 |
| 4,330,403 | 5/1982 | Fuchs | 209/170 |
| 4,643,852 | 2/1987 | Koslow | 209/170 |
| 5,143,600 | 9/1992 | Leiponen | 261/93 |

FOREIGN PATENT DOCUMENTS

| | | | |
|---|---|---|---|
| 483143 | 5/1974 | U.S.S.R. | 209/169 |
| 967580 | 10/1982 | U.S.S.R. | 209/169 |
| 990315 | 1/1983 | U.S.S.R. | 209/169 |
| 1592049 | 9/1990 | U.S.S.R. | 209/169 |
| 2000038 | 1/1979 | United Kingdom | 269/93 |
| 2039763 | 8/1980 | United Kingdom | 209/169 |

*Primary Examiner*—Thomas M. Lithgow
*Attorney, Agent, or Firm*—Brooks Haidt Haffner & Delahunty

[57] ABSTRACT

The invention relates to an apparatus for feeding air into a flotation cell provided with a rotor and a stator. According to the present invention, air is fed into the intermediate space formed in between the rotor and stator covers, to above the rotor, wherefrom the air is distributed symmetrically.

11 Claims, 4 Drawing Sheets

APPARATUS FOR FEEDING AIR INTO A FLOTATION CELL

CROSS REFERENCE TO RELATED INVENTION

This application is a continuation-in-part of prior copending application Ser. No. 639,040 filed Jan. 9, 1991 now U.S. Pat. No. 5,143,600.

BACKGROUND OF THE INVENTION

1. Field of the Invention

The present invention relates to apparatus for feeding air into a flotation cell provided with a rotor and a stator. According to the invention, air is fed into the intermediate space formed in between the top covers of the rotor and the stator, above the rotor, wherefrom the air spreads in a symmetrical fashion.

2. Description of Related Art

In the prior art there are known for example the flotation mechanisms introduced in the U.S. Pat. Nos. 4,078,026 and 4,800,017, which comprise a rotor and a stator, and where air is fed through a hollow shaft to inside the rotor, wherefrom it flows out through slurry ducts and aerates the slurry. In both of these U.S. patents, the stator blades of the mechanism are supported against each other by means of a supporting ring, which extends, when seen from the top, to the area of the disc formed by the stator blades.

The Swedish patent publication 398,978 describes a flotation apparatus where around the shaft of a blade mixer there is placed a pipe through which air is sucked into the flotation cell. Around the mixer there is a diffuser with a cover, which diffuser is at its outer edge provided with plates that are arched when observed from the top. On the bottom of the flotation cell, there are placed plates projected in a curved fashion outwards, from the center of the cell towards the periphery thereof, the purpose of which plates is to increase the amount of air sucked in. A similar type of apparatus is also introduced im the SE patent 398,826, but without the plates that regulate the air intake. This blade mixer is not provided with a special cover, but air is mixed with the slurry in similar fashion as the air conducted from within the rotor into the slurry ducts thereof.

The patent publication DE-AS 1,209,971 describes a cell of the Fagergren type, where both the rotor and the stator are formed of blades arranged in a ring. Air is conducted into the cell from around the rotor shaft, and it flows into the space inside the rotor blades through the top part of the rotor.

The U.S. Pat. Nos. 2,865,618 and 3,506,120 also describe feeding of air into the space above the rotor, in between the rotor and the stator, but in both cases the feeding is carried out eccentrically.

SUMMARY OF THE INVENTION

The drawback with the flotation mechanisms described above has been that particularly when the cells have been large and the material to be flotated coarse, the air fed through the inside of the rotor has at least partly filled the slurry ducts. As a consequence, the pumping capacity of the rotor has weakened. This has been proved for instance by the fact that the rotor has not been capable of keeping all solid material in suspension, but part of the solids has descended on the bottom of the tank. Similarly the hold-up contained in the slurry has been reduced. By means of the now developed new air feeding apparatus and method, the pumping capacity of the rotor is essentially raised; thus the slurry containing even coarse material can be maintained in suspension, and at the same time the hold-up of the slurry becomes essentially larger than before.

The invention provides several embodiments of apparatus for feeding air into a flotation mechanism through an air supply pipe or pipes for distributing the air in a symmetrical fashion. The several preferred embodiments of the apparatus for feeding air into a flotation cell will be understood when the specification is read in the light of the accompanying drawings.

DESCRIPTION OF THE DRAWINGS

FIG. 3 is a view similar to that of FIGS. 1 and 2, but showing another arrangement for supplying air.

DETAILED DESCRIPTION OF PREFERRED EMBODIMENTS

Figure 1:
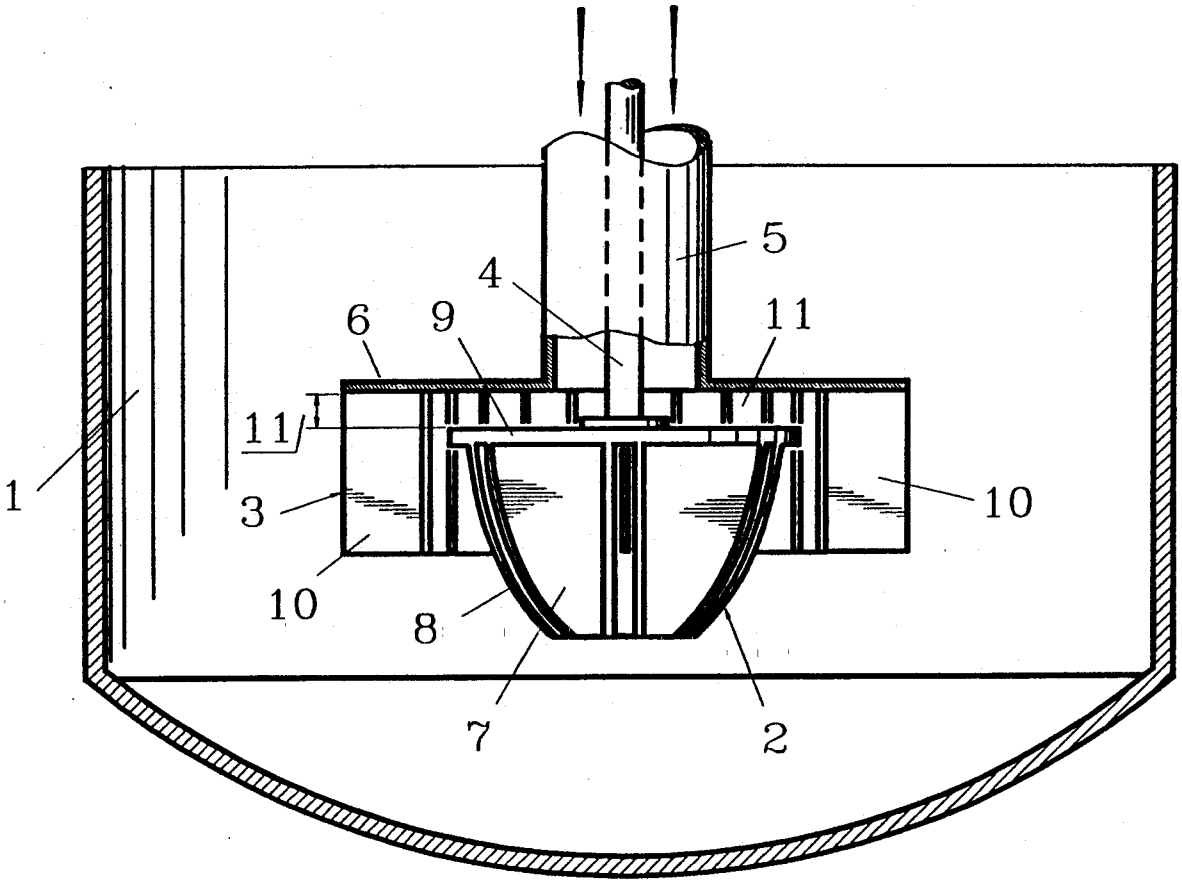
FIG. 1 is a view in vertical cross-section of one embodiment of the invention.

The new air feeding apparatus for a flotation cell is described in more detail in the drawings, which show vertical cross-sections of preferred embodiments of the apparatus of the invention.

FIG. 1 illustrates a flotation mechanism placed in the cell 1, which mechanism comprises a rotor 2 and a stator 3. The rotor is suspended from the shaft 4, and air is fed into the mechanism through the air supply pipe 5 located centrically around the shaft 4. The air supply pipe is fastened to the stator cover 6, which is open at the pipe 5, but otherwise closed. Air can of course be fed in other ways than from around the shaft, but it is advantageous that the feeding takes place in a symmetrical fashion. One such symmetrical feeding method is to feed air through several separate supply conduits. The rotor 2 is advantageously formed of the rotor blades 7, that are projected radially or in a roughly radial direction from the center outwards, and of the slurry ducts 8 left in between the blades, as well as of the cover plate 9, which is at least as large as the outer diameter of the top part of the rotor blades. The cover plate can also be somewhat larger than a circle defined by the tops of outer edges of the rotor blades as shown in the drawing, but not more than 20% larger.

According to the spirit of the invention, the rotor can be of some other shape, too, but the essential point is that it includes a uniform top cover member which prevents air from flowing into the slurry ducts. According to the drawing, the stator is formed of the said cover member 6 and of the stator blades 10 that are projected essentially downwards from the cover. Advantageously the stator blades do not extend down to the bottom, but the rotor blades 7 reach further down than the stator blades 10. The stator can also be of some other shape, but in practical experiments the above described form has been found advantageous. In the vertical direction the stator is placed at least partly higher up than the rotor, so that in between the stator cover and the rotor cover there remains an air distribution duct 11, whereto the supplied air is conducted to flow and to be evenly discharged therefrom to around the rotor. It is essential that on the horizontal plane the stator top cover 6 extends clearly further out than the rotor top cover 9, advantageously at least a length that is 0.2 times the diameter of the rotor. In the experiments that were carried out it was found that the distance in between the stator and rotor covers, i.e. the height of the air distribution duct, should be as short as possible, generally 2–20% of the diameter of the rotor cover, advantageously 7–12% of the diameter of the rotor cover.

Generally the most advantageous arrangement is to install the flotation mechanism in the flotation cell so that the rotor and stator covers are placed horizontally, but if particular reasons arise, the flotation mechanism can also be placed in an inclined position with respect to the cell, so that the rotor and stator covers are still parallel, but form an angle with the horizontal plane, the maximum of this angle being 30°. Neither is it necessary that the rotor and stator covers be mutually parallel, but in some cases they can be divergent, so that the height of the air distribution duct remaining in between the covers is either widened or narrowed while proceeding towards the outer periphery of the rotor. In practice this is achieved by means of the design of the rotor cover.

According to this new arrangement air is fed to above the rotor, and therefore the rotor slurry ducts are not filled with air anymore, but the rotor is capable of mixing the slurry to its full effect. However, the turbulence created by the rotor is effectively utilized at the outer edge of the rotor cover, where air is mixed into the slurry pumped by the rotor and broken up into small bubbles. Thus the slurry discharged from the slurry ducts is effectively mixed with the air fed in from around the rotor. One value that describes the efficiency of the flotation is the hold-up of the slurry, and it has been found that according to the method of the present invention, this hold-up can be essentially increased with respect to the flotation mechanisms operated in the previously known fashion.

Figure 2:
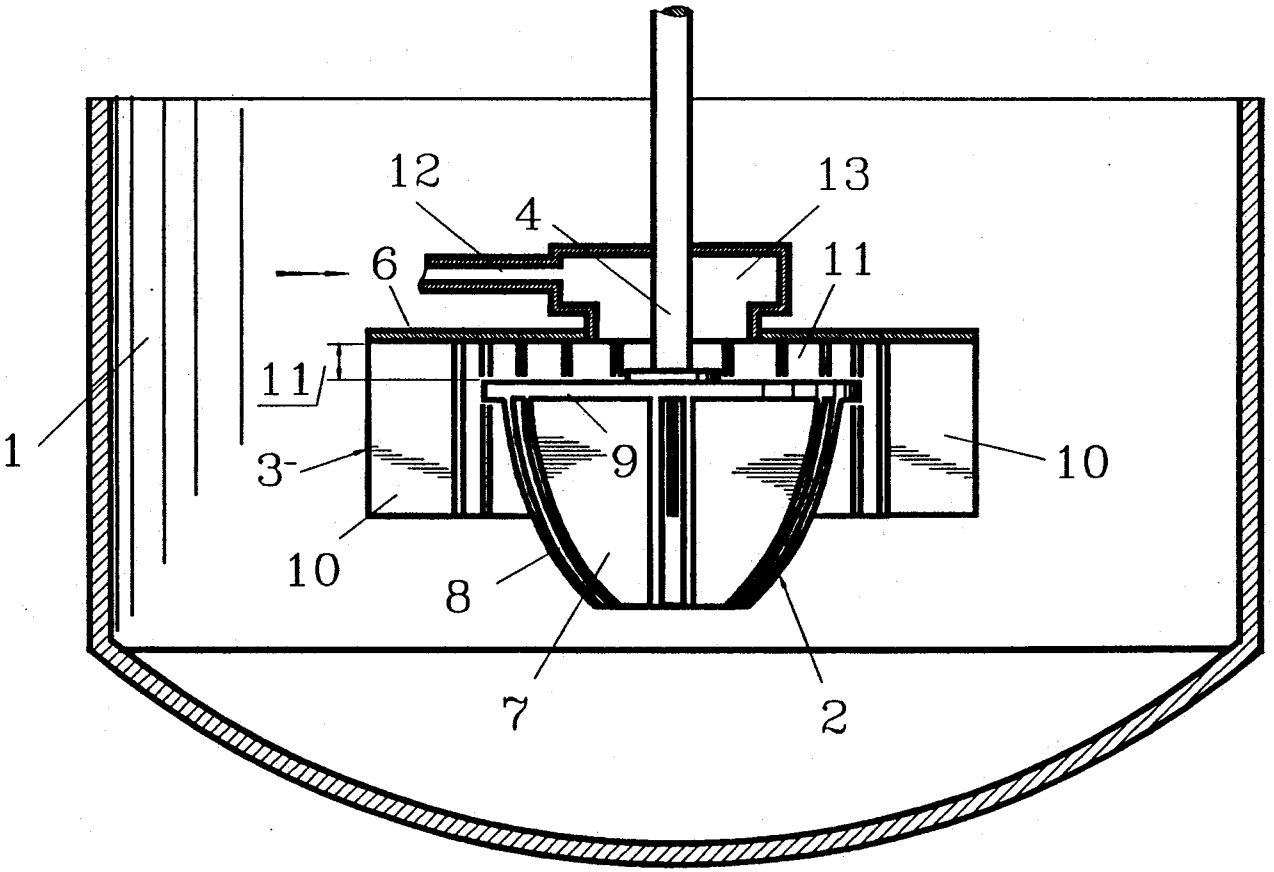
FIG. 2 is a view similar to that of FIG. 1, showing another arrangement for supplying air.
Figure 4:
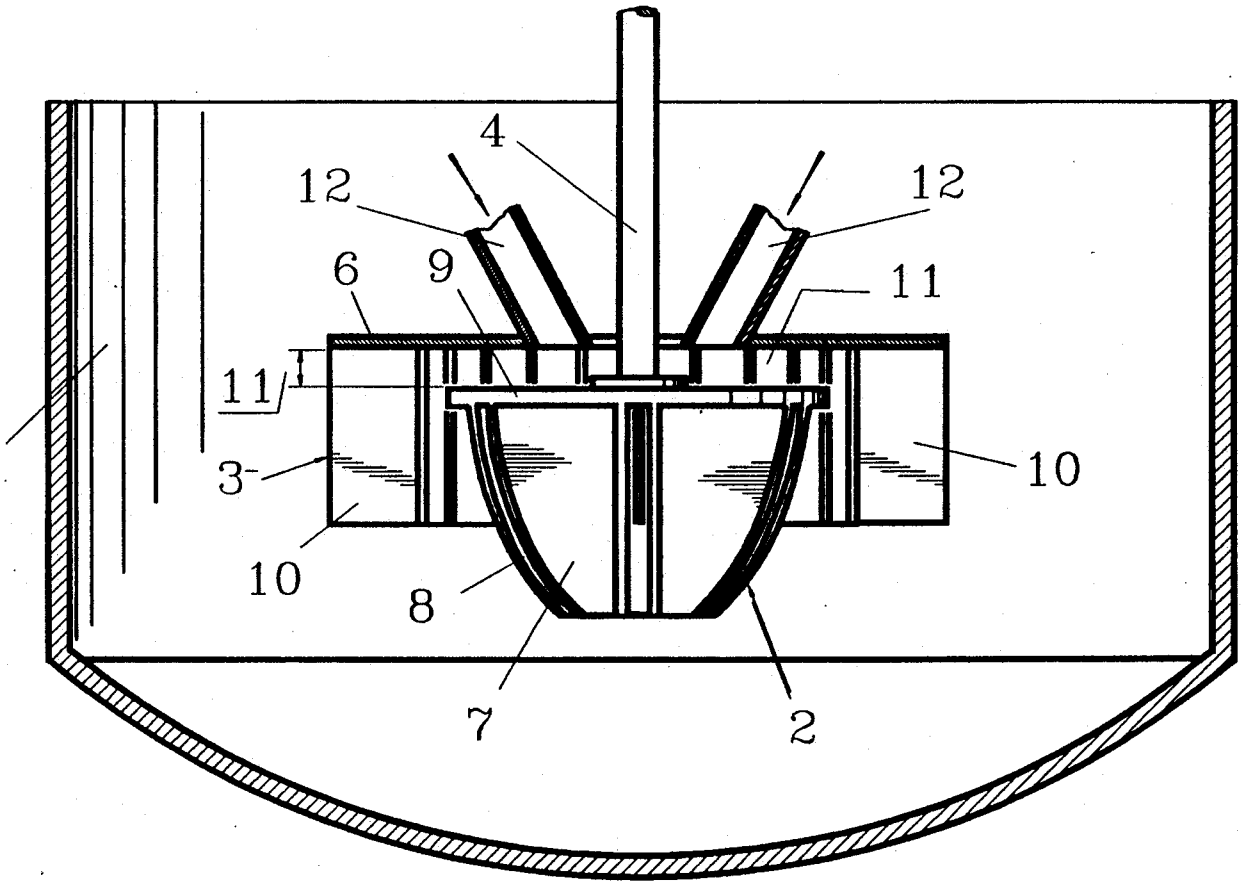
FIG. 4 is a view similar to that of FIGS. 1-3, but showing yet another air supply arrangement.
Figure 4:
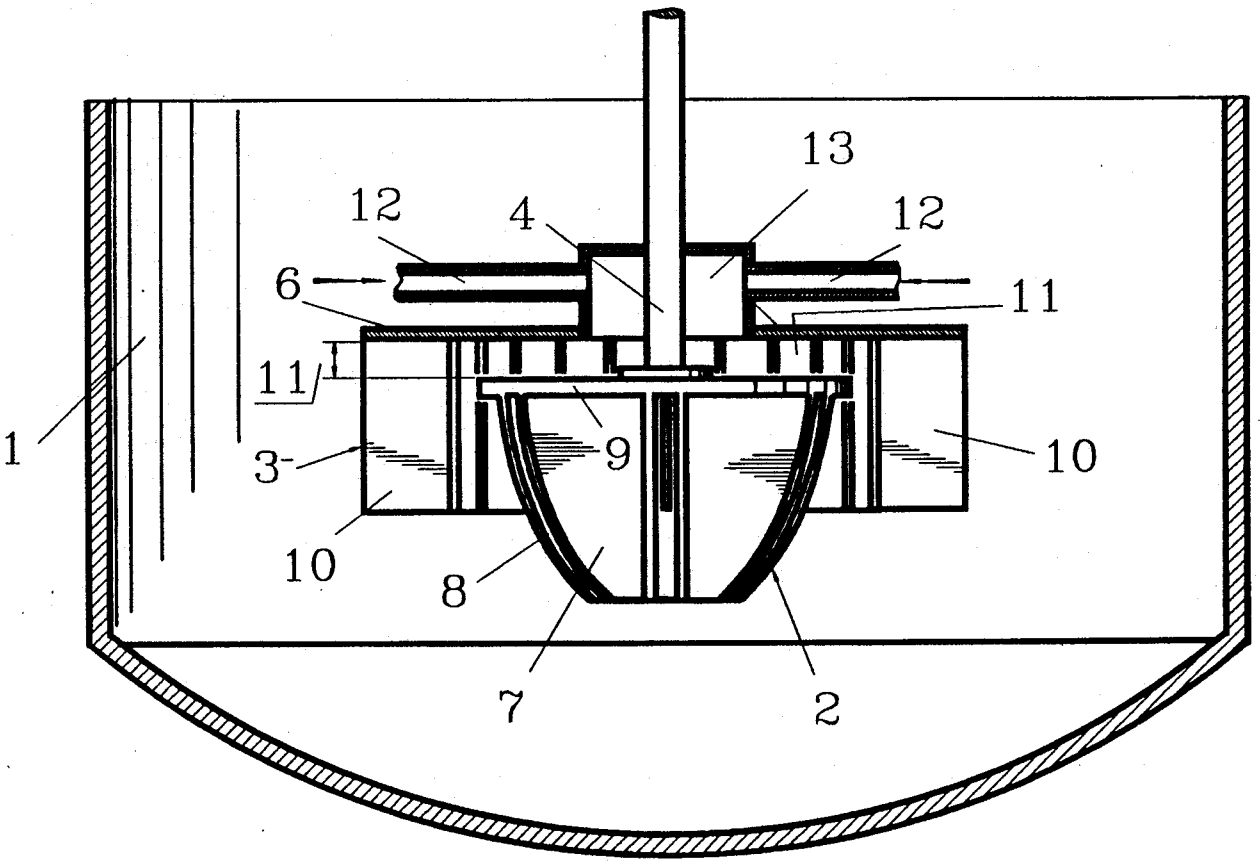

FIGS. 2, 3 and 4 show alternative arrangements for feeding air into a flotation cell for applications in which it is preferred not to employ a pipe surrounding the shaft 4. As in the embodiment of FIG. 1, these other arrangements all provide for symmetrical air distribution through an air distribution duct 11 arranged between the stator cover 6 and the rotor cover 9. The embodiments of FIGS. 2, 3 and 4 do not, however, employ an air supply pipe concentric with the rotor shaft 4 like the air supply pipe of the embodiment of FIG. 1. The air supply pipe or pipes in FIGS. 2–4 extend toward the rotor shaft from the side. Aside from the means for supplying air to the air distribution duct 11, the embodiments of FIGS. 2–4 are essentially the same as that of FIG. 1, with a rotor 2 formed of blades 7 that project generally radially from the center outwards, slurry ducts 8 between the blades 7, and a rotor top cover plate 9 which is at least as large as the outer diameter of the top parts of the rotor blades 7. The cover plate 9 can be somewhat larger than a circle defined by the tops of outer edges of the rotor blades, but not more than 20% larger.

Turning now to FIG. 2, which shows a flotation mechanism which is essentially the same as that of FIG. 1 except for the air distribution arrangement, it will be seen that air is conducted into the mechanism through a pipe 12, which is not located concentrically about the rotor shaft 4, but generally extends in a radial direction with respect to the shaft. The pipe 12 delivers air to an annular, box-like gas distributing chamber 13 which is located concentrically about the shaft 4, above the stator cover 6. The stator cover 6 is open around the shaft 4 to the interior of the chamber 13 for entry of air into the air distribution duct 11 from the chamber 13, but otherwise the stator cover 6 closes from above the air distribution duct 11. Air is thus fed from the pipe 12 to the chamber 13 and thence to the air distribution duct between the stator cover 6 and the rotor cover 9 whereby symmetrical air distribution is achieved as in the embodiment of FIG. 1.

FIG. 3 shows an arrangement in which air is fed through several pipes 12 (only two of which are shown) to the air distribution duct 11. The pipes 12 are arranged symmetrically around the rotor shaft 4 in a generally radial arrangement. The stator cover 6 has openings for passage of air from the pipes 12. The pipes are shown arranged at an angle with respect to the cover 6, which has openings at the pipe ends. Aside from this modification in the air supply arrangement, the apparatus of FIG. 3 is like those of FIGS. 1 and 2.

The arrangement shown in FIG. 4 has several pipes 12 for feeding air to an annular, box-like air distribution chamber 13 which is similar to the chamber of FIG. 2. The pipes 12 extend generally radially inward to open at their inner ends into the chamber 13. The chamber 13 is fastened above the stator cover 6 and situated concentrically around the shaft 4. The stator cover 6 has an opening around the shaft 4 for entry of air from the chamber 13. In other respects aside from the air supply arrangement, the apparatus of FIG. 4 is the same as the embodiments of FIGS. 1–3.

In conclusion, the advantages of the method and apparatus of the present invention can be listed as follows: By employing the apparatus, there is achieved an effective pumping irrespective of the amount of air used, in which case the slurry density and grain size gradient also remain evenly small throughout the cell volume. This has an extremely positive effect with respect to the success of the flotation. The meeting of bubbles and mineral particles is extremely efficient outside the rotor, both in the stator and already in the intermediate space before that. This is a basic prerequisite for the flotation process, and increases the yield of valuable metals. In this embodiment sanding has been eliminated, and thus the whole of the cell volume is in efficient use. Consequently the apparatus is capable of treating slurries containing even coarse grains without operational disturbances. The air feeding method of the invention is practical also when the flotation mechanism is applied to the aeration of waste waters. In certain cases the stator top cover can be replaced with plates attached to the shaft or to the rotor, in which case air is fed in between the said plate and the rotor cover. This method is advantageous particularly when the stator plates are desired to be placed in conventional fashion on the same level with the rotor blades, or lower, or if the stator blades are desired to be taken further to the circumference of the flotation cell.

What is claimed is:

1. An apparatus for feeding air into a flotation mechanism, comprising a stator and a rotor each provided with a generally disc-shaped top cover, said disc-shaped stator top cover having a larger diameter than said disc-shaped rotor top cover and said stator top cover being concentrically positioned above and adjacent to said rotor top cover thereby defining an air distribution duct between said top covers, said rotor top cover having a plurality of rotor blades extending vertically downward from said rotor top cover and said stator top cover having a plurality of stator blades extending vertically downward therefrom to below the top cover of the rotor, a rotor shaft for rotating said rotor, air supply means comprising a plurality of air supply pipes extending generally radially toward an axis of rotation of said rotor shaft, said air supply pipes communicating with said air distribution duct through at least one opening in said stator top cover, said rotor top cover being uniform and imperforate for preventing air from said air distribution duct from flowing to spaces between the rotor blades, and whereby air is distributed symmetrically around the rotor.

2. An apparatus for feeding air into a flotation mechanism, comprising a stator and a rotor each provided with a generally disc-shaped top cover, said disc-shaped stator top cover having a larger diameter than said disc-shaped rotor top cover and said stator top cover being concentrically positioned above and adjacent to said rotor top cover thereby defining an air distribution duct between said top covers, said rotor top cover having a plurality of rotor blades extending vertically downward from said rotor top cover and said stator top cover having a plurality of stator blades extending vertically downward therefrom to below the top cover of the rotor, a rotor shaft for rotating said rotor, air supply means comprising a chamber symmetrically located around said rotor shaft, said chamber being mounted on said stator top cover above a central opening in said stator top cover thereby communicating with said air distribution duct, and at least one air supply pipe extending generally radially toward an axis of rotation of said rotor shaft and having an open end attached to said chamber, said rotor top cover being uniform and imperforate for preventing air from said air distribution duct from flowing to spaces between the rotor blades, and whereby air is distributed symmetrically around the rotor.

3. An apparatus for feeding air into a flotation mechanism, comprising a stator and a rotor each provided with a generally disc-shaped top cover, said disc-shaped stator top cover having a larger diameter than said disc-shaped rotor top cover and said stator top cover being concentrically positioned above and adjacent to said rotor top cover thereby defining an air distribution duct between said top covers, said rotor top cover having a plurality of rotor blades extending vertically downward from said rotor top cover and said stator top cover having a plurality of stator blades extending vertically downward therefrom to below the top cover of the rotor, a rotor shaft for rotating said rotor, air supply means comprising an air distribution chamber mounted on said stator top cover concentrically around said rotor shaft, the interior of said air distribution chamber being in communication with said air distribution duct through an opening in said stator top cover, and at least one air supply pipe having an end attached to said air distribution chamber at a location spaced away from said shaft, said rotor top cover being uniform and imperforate for preventing air from said air distribution duct from flowing to spaces between the rotor blades, and whereby air is distributed symmetrically around the rotor.

4. The apparatus of any of claims 1–3 wherein the height of the air distribution duct is 2–20% of the diameter of the rotor top cover.

5. The apparatus of claim 4 wherein the height of the air distribution duct is 7–12% of the diameter of the rotor top cover.

6. The apparatus or any or the claims 1–3 wherein the diameter of the rotor top cover is larger than that of a circle drawn about top outer edges of blades of the rotor.

7. The apparatus of claim 6 wherein the rotor top cover is at most 20% larger than said circle.

8. The apparatus of any of claims 1–3 wherein the diameter of the rotor top cover is of the same size as that of a circle drawn about top outer edges of blades of the rotor.

9. The apparatus of any of claims 1–3 wherein in the vertical direction the rotor blades reach further down than the stator blades.

10. The apparatus of any of claims 1–3 wherein the diameter of the stator top cover is about 1.2 times the diameter of the rotor top cover.

11. The apparatus of any of claims 1–3 wherein both the stator top cover and the rotor cop cover are arranged horizontally.

* * * * *